US008602746B2

(12) United States Patent
Gallwey et al.

(10) Patent No.: US 8,602,746 B2
(45) Date of Patent: Dec. 10, 2013

(54) ELECTRICAL SYSTEM FOR A PUMP

(75) Inventors: Brady Gallwey, Houston, TX (US); Roy Tilford Jackson, Houston, TX (US); Duy D. Nguyen, Houston, TX (US); C. Tom Brannon, Houston, TX (US)

(73) Assignee: TXAM Pumps, LLC, Houston, TX (US)

( * ) Notice: Subject to any disclaimer, the term of this patent is extended or adjusted under 35 U.S.C. 154(b) by 977 days.

(21) Appl. No.: 12/127,230

(22) Filed: May 27, 2008

(65) Prior Publication Data

US 2009/0297362 A1 Dec. 3, 2009

(51) Int. Cl.
*F04B 49/06* (2006.01)

(52) U.S. Cl.
USPC ..... 417/44.11; 417/411; 700/282; 388/811

(58) Field of Classification Search
USPC ..... 417/44.1, 411, 44.11; 700/282; 388/811
See application file for complete search history.

(56) References Cited

U.S. PATENT DOCUMENTS

| | | | | | |
|---|---|---|---|---|---|
| 4,786,851 | A * | 11/1988 | Fuji et al. | ..... | 320/101 |
| 5,131,816 | A * | 7/1992 | Brown et al. | ..... | 417/2 |
| 5,764,034 | A * | 6/1998 | Bowman et al. | ..... | 320/155 |
| 6,052,998 | A * | 4/2000 | Dage et al. | ..... | 62/89 |
| 2004/0009075 | A1 * | 1/2004 | Meza et al. | ..... | 417/32 |
| 2004/0074897 | A1 * | 4/2004 | Krieger et al. | ..... | 219/497 |

* cited by examiner

*Primary Examiner* — Charles Freay
*Assistant Examiner* — Thomas Fink
(74) *Attorney, Agent, or Firm* — Conley Rose, P.C.

(57) ABSTRACT

In at least some embodiments, an electrical system for a pump includes a power supply and a controller coupled to the power supply, the controller supporting a plurality of pump cycle levels. If a voltage of the power supply drops below a first threshold, the controller automatically causes the pump to operate at a lower pump cycle level.

14 Claims, 4 Drawing Sheets

| | | | | | | |
|---|---|---|---|---|---|---|
| 202 | **VOLTAGE THRESHOLD LEVEL** | 4 | 3 | 2 | 1 | 0 |
| 204 | **VOLTAGE RANGE (VOLTS)** | > 12.0 | 12.0 to 11.6 | 11.6 to 11.2 | 11.2 to 10.8 | < 10.8 |
| 206 | **LED CONTROL** | GREEN | GREEN + YELLOW | YELLOW | YELLOW + RED | RED |
| 208 | **PUMP CYCLE LEVEL** | 10 | 7 | 5 | 3 | OFF |
| | | 9 | 6 | 5 | 3 | OFF |
| | | 8 | 6 | 4 | 3 | OFF |
| | | 7 | 5 | 4 | 2 | OFF |
| | | 6 | 4 | 3 | 2 | OFF |
| | | 5 | 3 | 3 | 2 | OFF |
| | | 4 | 3 | 2 | 1 | OFF |
| | | 3 | 2 | 2 | 1 | OFF |
| | | 2 | 1 | 1 | 1 | OFF |
| | | 1 | 1 | 1 | 1 | OFF |

200

FIG. 2

ELECTRICAL SYSTEM FOR A PUMP

BACKGROUND

A pump is a device that moves fluid from a first location to a second location. In some instances, a pump moves fluid from a lower pressure to a higher pressure. To perform these functions, the pump requires energy. If the pump has a limited power supply, proper management of the pump's power consumption is important.

BRIEF DESCRIPTION OF THE DRAWINGS

For a detailed description of exemplary embodiments of the invention, reference will now be made to the accompanying drawings in which:

FIG. 2 shows a pumping rate control chart in accordance with embodiments of the disclosure;

NOTATION AND NOMENCLATURE

Certain terms are used throughout the following description and claims to refer to particular system components. As one skilled in the art will appreciate, computer companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . . " Also, the term "couple" or "couples" is intended to mean either an indirect, direct, optical or wireless electrical connection. Thus, if a first device couples to a second device, that connection may be through a direct electrical connection, through an indirect electrical connection via other devices and connections, through an optical electrical connection, or through a wireless electrical connection.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Embodiments of the disclosure are directed to pumps having a limited power supply. In at least some embodiments, the power consumption of a pump is managed by automatically adjusting a pump cycle level in response to a power supply voltage level. In at least some embodiments, adjusting the pump cycle level involves changing the number of on/off cycles per minute of the pump. Additionally or alternatively, adjusting the pump cycle level may involve changing the "duty cycle" for each on/off cycle (e.g., the "on" portion of each on/off cycle may be set at 2, 3, 4, or 5 seconds). If the power supply voltage level drops below predetermined thresholds, the pump cycle level is automatically lowered. Similarly, if the power supply voltage level rises above the predetermined thresholds, the pump cycle level is automatically increased. In at least some embodiments, the pump indicates a current pump cycle level and/or power supply voltage level to a user. Further, the pump may enable a user to dynamically select a default pump cycle level.

Figure 1:
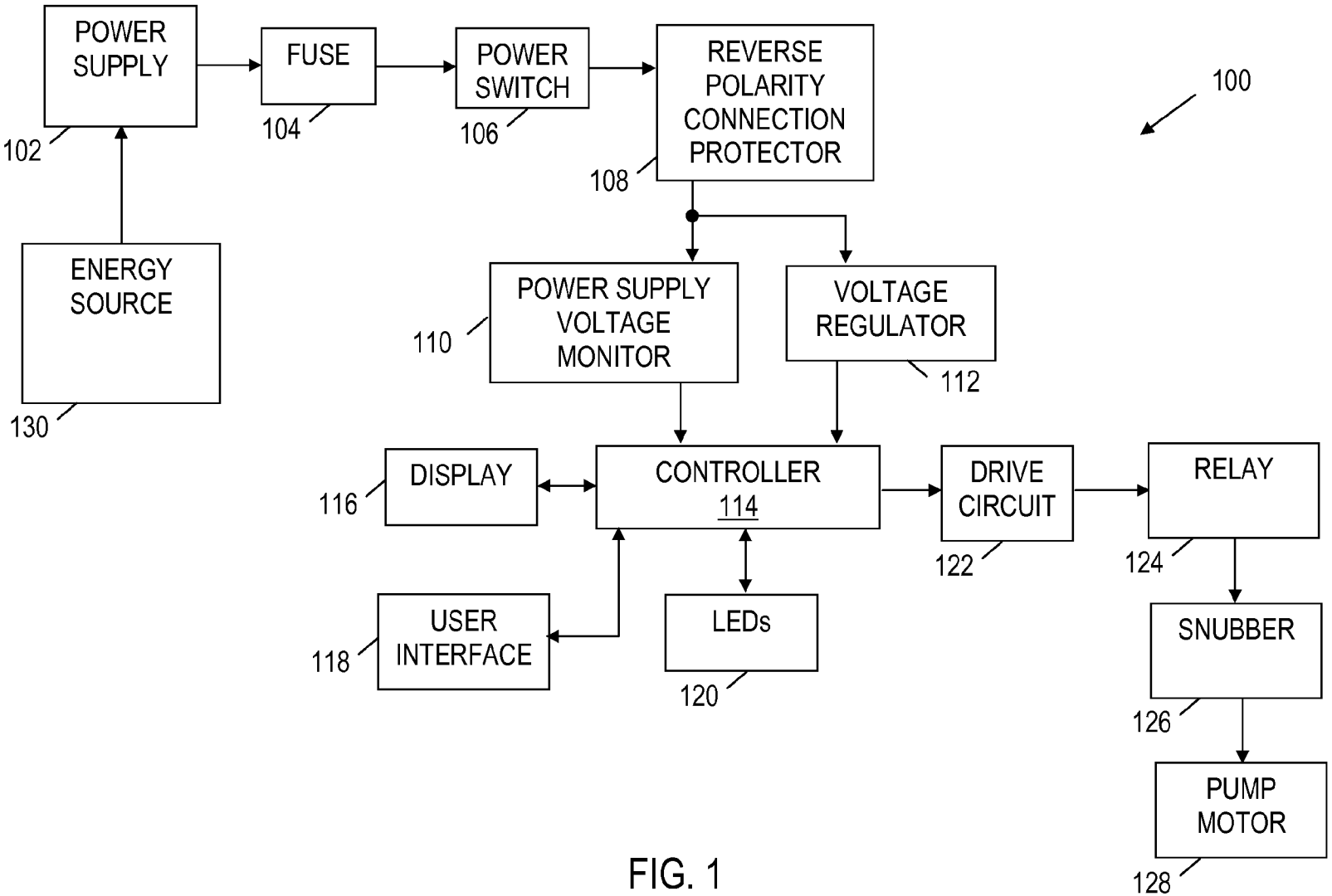
FIG. 1 shows an electrical system in accordance with embodiments of the disclosure.

FIG. 1 shows an electrical system 100 in accordance with embodiments of the disclosure. In FIG. 1, a controller 114 manages the power consumption of a pump motor 128 by monitoring the voltage level of a power supply 102 coupled to the controller 114 and automatically adjusting a pump cycle level of the pump motor 128 based on the monitored voltage level. In at least some embodiments, the power supply 102 corresponds to a rechargeable power supply (e.g., a battery or fuel cell). In such case, the power supply 102 may be recharged by an energy source 130 coupled to the power supply. Examples of a suitable energy source 130 include, but are not limited to, a solar panel, a wind turbine and/or a hydro-electric turbine.

The voltage monitoring function is performed by a power supply voltage monitor 110 in communication with the controller 114. In at least some embodiments, a user interface 118 coupled to the controller 114 enables a user to select a default pump cycle level. The user interface 118 may be, for example, a button, a keyboard, a mouse, or other input devices. In at least some embodiments, a display 116 provides system information related to the electrical system 100 such as the default pump cycle level, the current pump cycle level, the power supply voltage level, or other system information. Additionally or alternatively, some or all of the system information can be provided using light emitting diodes (LEDs) coupled to the controller 114.

In at least some embodiments, a fuse 104, a power switch 106, a reverse polarity connection protector 108, and a voltage regulator 112 are part of the electrical system 100. The fuse 104 causes an open circuit between the power supply 102 and the rest of the electrical system 100 if the current level from the power supply 102 exceeds a predetermined threshold. The power switch 106 enables a user to turn the electrical system 100 on and off. The reverse polarity connection protector 108 protects against the consequences of improper installation of the power supply 102, accidental short circuits, and other types of careless use. As an example, the reverse polarity connection protector 108 may comprise a series diode, a shunt diode and/or a metal-oxide-semiconductor field-effect transistor (MOSFET). The voltage regulator 112 supplies power to various control components of the electrical system 100.

In at least some embodiments, a drive circuit 122, a relay 124, and a snubber 126 are part of the electrical system 100. The drive circuit 122 drives the relay 124. The relay 124 provides an additional or alternative control switch for providing power to the pump motor 128. In some embodiments, the relay 124 may correspond to a solid-state switch. In some embodiments, the controller 114 may selectively open or close the relay 124 to control whether the pump motor 128 receives the supplied power. The snubber 126 protects the pump motor 128 against voltage spikes, which may occur when current to the pump motor 128 is rapidly interrupted. The snubber 126 may comprise, for example, an RC (resistor-capacitor) circuit, a diode, or a zener diode.

The pump motor 128 is configured to rotate in at least one direction in accordance with a pump cycle level control signal provided by the controller 114. In at least some embodiments, the pump motor 128 operates on 12 or 24 volts. The pump motor 128 is used to drive a pump (e.g., a reciprocating pump). Without limitation to other embodiments, the pump may be a chemical injection pump having the features shown in Table 1.

TABLE 1

| | |
|---|---|
| Maximum Pressure | 4000 psi |
| Plunger sizes | ¼", ⅜", ½" |
| Output gallons/day | Up to 200 |

In at least some embodiments, the electrical system 100 employs a rechargeable battery as the power supply 102. In such case, the rechargeable battery may be recharged using available solar panels (e.g., 50/60/85/110 watt panels) as the energy source 130. Thus, the electrical system 100 and the associated pump are suitable for use in remote locations if desired. For more information regarding relevant pumps, reference may be had to co-pending application Ser. No. 12/127,216, entitled "Pump With Stabilization Component", filed May 27, 2008. The above application is hereby incorporated herein by reference in its entirety.

FIG. 2 shows a pumping rate control chart 200 in accordance with embodiments of the disclosure. In FIG. 2, five threshold levels (0-4) 202 are shown corresponding to five different voltage ranges 204. In at least some embodiments, each threshold level 202 also corresponds to a different LED control signal 206. Further, various sets 208 of pumping rates (on/off cycles per minute) are shown for the threshold levels 202.

In FIG. 2, the threshold level 4 corresponds to a green LED control signal, which indicates that the power supply voltage is greater than 12 volts. The threshold level 3 corresponds to a green LED plus a yellow LED control signal, which indicates that the power supply voltage is in the range of 11.6 to 12 volts. The threshold level 2 corresponds to a yellow LED control signal, which indicates that the power supply voltage is in the range of 11.2 to 11.6 volts. The threshold level 1 corresponds to a yellow LED plus a red LED control signal, which indicates that the power supply voltage is in the range of 10.8 to 11.2 volts. The threshold level 0 corresponds to a red LED control signal, which indicates that the power supply voltage is less than 10.8 volts. In alternative embodiments, the LED control signals and the voltage ranges corresponding to the threshold levels may vary. Further, in some embodiments, LED control signals could be replaced by other threshold level indicators (e.g., a number on a display or other indicator). Further, in alternative embodiments, additional or fewer threshold levels may used.

In at least some embodiments, the controller 114 described previously for FIG. 1 supports a plurality of pump cycle levels. Varying the pump cycle level affects the output capacity (e.g., gallons/day) of the pump. Lower pump cycle levels consume less energy because less pumping is involved. In the embodiment of FIG. 2, up to 10 pump cycle levels are supported for threshold level 4, up to 7 pump cycle levels are supported for threshold level 3, up to 5 pump cycle levels are supported for threshold level 2 and up to 3 pump cycle levels are supported for threshold level 1. No pump cycle levels are supported for threshold level 0. As previously discussed, each pump cycle level may correspond to a number of on/off cycles per minute as well as a predetermined duty cycle for each on/off cycle.

In at least some embodiments, a user is able to select a default pump cycle level (1 to 10). For the threshold level 4, the default pumping rate may be maintained indefinitely. However, if the power supply voltage level drops from threshold level 4 to threshold level 3, the selected pump cycle level is automatically decreased to a predetermined level (except when pump cycle level 1 has been selected). For example, the pump cycle level 10 (the highest pump cycle level for threshold 4) would decrease to pump cycle level 7 and so on. Similarly, if the power supply voltage level drops from threshold level 3 to threshold level 2, the pump cycle levels decrease even more. For example, the pump cycle level 7 (the highest pump cycle level for threshold 3) would decrease to pump cycle level 5 and so on. Similarly, if the power supply voltage level drops from threshold level 2 to threshold level 1, the pump cycle levels decrease even more. For example, the pump cycle level 5 (the highest pump cycle level for threshold 2) would decrease to pump cycle level 3 and so on. If the power supply voltage drops from threshold level 1 to threshold level 0, the controller 114 turns the pump OFF or otherwise prevents power consumption. Preventing power consumption during threshold level 0 protects against high current conditions, which would otherwise occur if voltage continues to drop as power is demanded from a load. These high current conditions are potentially damaging to the power supply 102 or other components of the electrical system 100.

If the voltage rises from threshold level 0 to threshold level 1, the controller 114 increases the pump cycle level from the OFF state to a predetermined pump cycle level. For example, if the default pump cycle level is 10, the pump cycle level for threshold level 1 would be 3 and so on. If the power supply voltage rises to the threshold level 4, the default pump cycle level previously selected by the user is restored again. By enabling the pump cycle levels to automatically increase and decrease in accordance with the power supply voltage level and in accordance with a user-selectable default level, power consumption is effectively managed.

The pump cycle control chart 200 of FIG. 2 is illustrative only and is not intended to limit embodiments of the disclosure. Rather, the chart 200 illustrates that pump cycle levels may vary based on a plurality of power supply voltage threshold levels as well as a plurality of user-selectable pump cycle levels. In at least some embodiments, each pump cycle level corresponds to an equivalent number of on/off cycles per minute (e.g., pump cycle level 10 corresponds to 10 on/off cycles per minute). The duty cycle for each on/off cycle may be set at 50% by default. In at least some embodiments, a user is able to dynamically increase or decrease the duty cycle for each on/off cycle as desired via a user interface.

Figure 3:
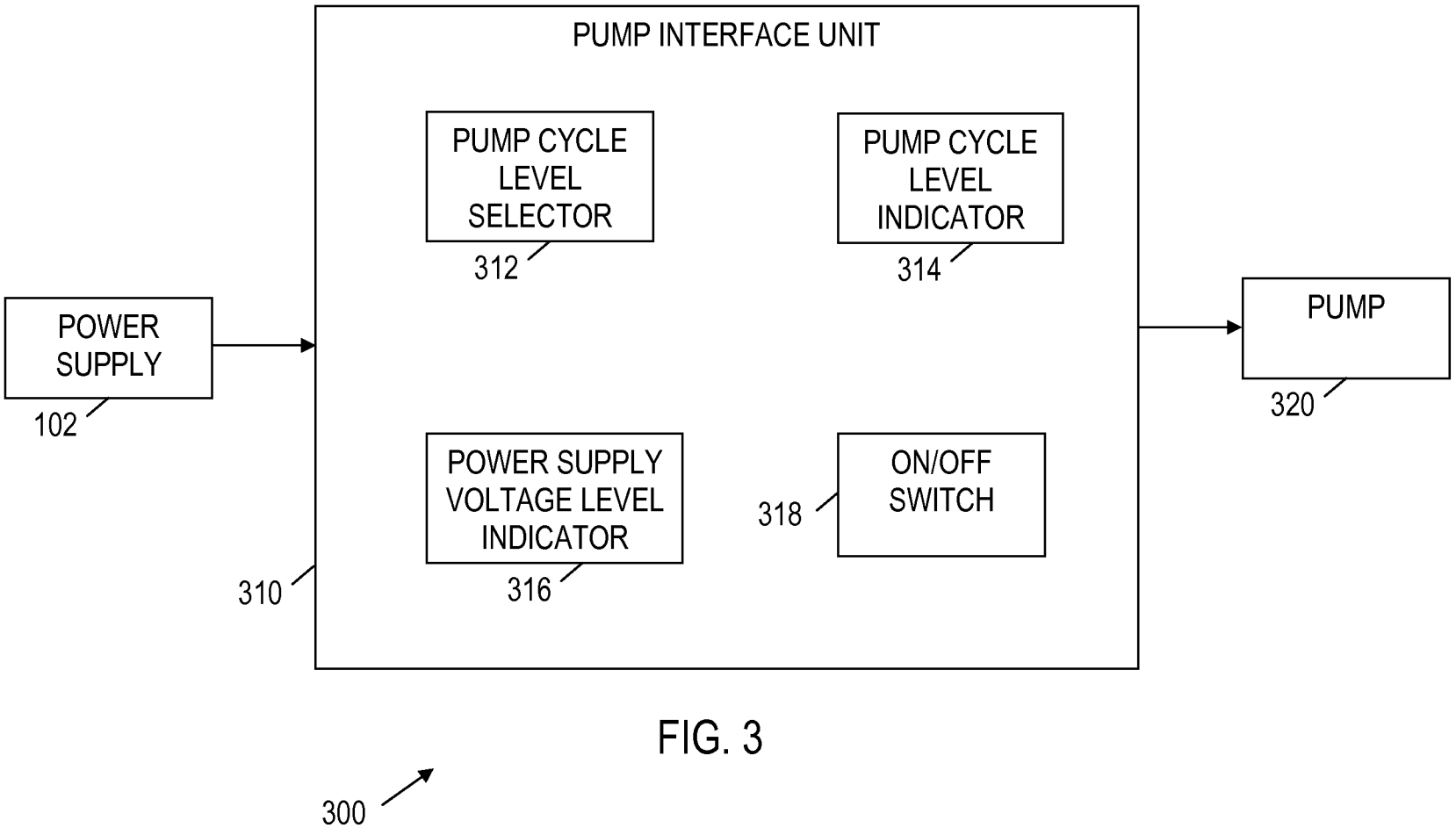
FIG. 3 shows various features of a pump system in accordance with embodiments of the disclosure.

FIG. 3 shows various features of a pump system 300 in accordance with embodiments of the disclosure. In FIG. 3, a pump interface unit 310 couples to the power supply 102 and a pump 320. In at least some embodiments, the pump interface unit 310 is separate from the power supply 102 and the pump 320. Alternatively, the power supply 102 and the pump interface unit 310 may be a part of a single unit, which is separate from the pump 320. Alternatively, the pump 320 and the pump interface unit 310 are part of a single unit, which is separate from the power supply 102. Alternatively, power supply 102, the pump interface unit 310, and the pump 320 are part of a single unit.

The pump interface unit 310 facilitates user interaction with the pump system 300 by providing system information and by accepting user input. In the embodiment of FIG. 3, the pump interface unit 310 comprises a pump cycle level selector 312, a pump cycle level indicator 314, a power supply voltage level indicator 316 and an on/off switch 318.

The pump cycle level selector 312 enables a user to dynamically select a default pump cycle level (e.g., levels 1-10 for threshold level 4 in FIG. 2). Again, the default pump cycle level may correspond to a number of on/off cycles per minute as well as a duty cycle for each on/off cycle. In some embodiments, a user may simply enter a desired output (e.g., gallons/day) in order to select the default pump cycle level. In various embodiments, the pump cycle level selector 312 may be simple (e.g., one or more buttons/switches) or complex (e.g., a computer with an associated keyboard, mouse, and display).

The pump cycle level indicator 314 indicates the current pump cycle level. In at least some embodiments, the pump cycle level indicator 314 may also indicate the default pump cycle level, the current duty cycle for on/off cycles, or the default duty cycle for on/off cycles. Examples of suitable pump cycle level indicators include, but are not limited to, programmable number displays (e.g., LED or liquid crystal display (LCD)), analog needle gauges, LED lights, or a computer display.

The power supply voltage level indicator 316 indicates the current voltage level of the power supply and/or an associated threshold level. Examples of suitable power supply voltage level indicators include, but are not limited to, programmable number displays (e.g., LED or liquid crystal display (LCD)), analog needle gauges, LED lights, or a computer display. In the example of FIG. 2, a combination of LEDs (green, yellow, and red) is used to indicate five different threshold levels. As previously mentioned, additional or fewer threshold levels may be employed. Additionally or alternatively, the actual voltage level itself may be displayed.

The on/off switch 318 enables a user to turn the pump system 300 on or off. For example, the on/off switch 318 may be a button or switch. Alternatively, the on/off switch 318 may be a selectable icon or graphic representation of a computer application. In at least some embodiments, a stand-by mode may be supported (i.e., some features of the pump system 300 are powered off while others are maintained to facilitate start-up).

Figure 4:
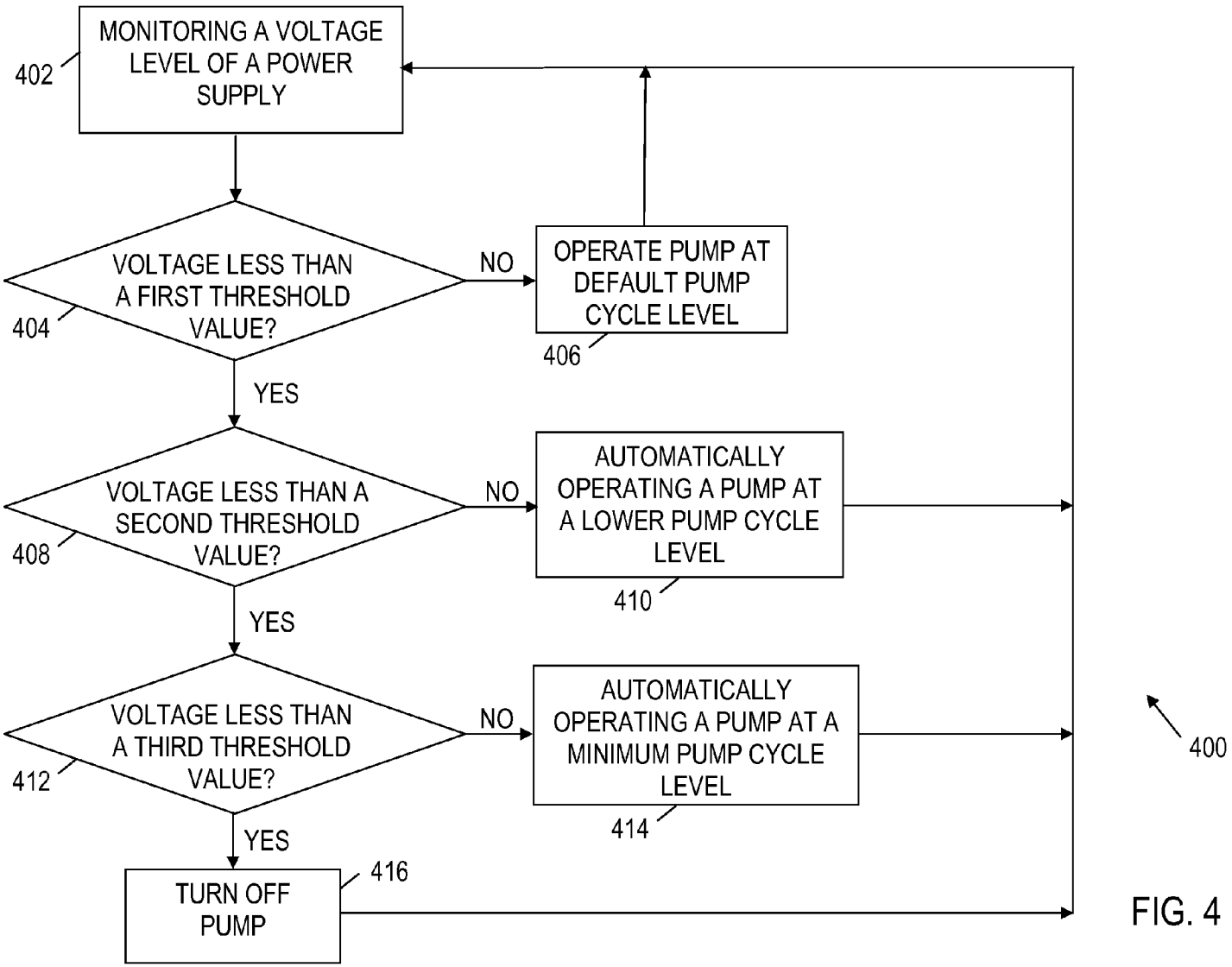
FIG. 4 shows a method in accordance with embodiments of the disclosure.

FIG. 4 shows a method 400 in accordance with embodiments of the disclosure. The method 400 comprises monitoring the voltage level of a power supply (block 402). If the voltage is not less than a first threshold value (determination block 404), a pump is operated at a default pump cycle level (block 406). As previously described, in some embodiments, a user dynamically selects the default pump cycle level. Alternatively, the default pump cycle level may be fixed to some predetermined level.

If the voltage is less than the first threshold value (determination block 404), the method 400 determines whether the voltage is less than a second threshold value (determination block 408). If the voltage is not less than the second threshold value (determination block 408), the pump is automatically operated at a lower pump cycle level (block 410). If the voltage is less than the second threshold value (determination block 408), the method determines whether the voltage is less than a third threshold value (determination block 412). If the voltage is not less than the third threshold value (determination block 412), the pump is automatically operated at a minimum pump cycle level (block 414). If the voltage is less than the third threshold value (determination block 412), the pump is turned off or is otherwise prevented from consuming power (block 416). The method 400 may be used to effectively manage the power consumption of a pump having a limited power supply. In alternative embodiments, additional threshold levels may be employed.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. An electrical system for a chemical injection pump, comprising:

a power supply;

a controller coupled to the power supply, the controller supporting a plurality of reciprocating pump activity levels, wherein each reciprocating pump activity level corresponds to a different predetermined integer number of on/off reciprocating pump cycles within a time period, and a user interface coupled to the controller, the user interface displays a plurality of predetermined integer numbers of on/off reciprocating pump cycles for each of the pump activity levels and receives a user input identifying a default predetermined integer number of on/off reciprocating pump cycles for a first activity level;

wherein, if a voltage of the power supply drops below a first threshold, the controller automatically causes the chemical injection pump to operate at a second reciprocating pump activity level, the second reciprocating pump activity level associated with a lower predetermined integer number of on/off reciprocating pump cycles than the first activity level, wherein, if the voltage of the power supply drops below a second threshold, the controller automatically causes the chemical injection pump to operate at a minimum reciprocating pump activity level, the minimum reciprocating pump activity level associated with a lower predetermined integer number of on/off reciprocating pump cycles than the second activity level, wherein, if the voltage of the power supply drops below a third threshold, the controller automatically causes the chemical injection pump to turn off, and wherein, if the voltage of the power supply rises above the first threshold, the controller automatically causes the chemical injection pump to operate at the first activity level.

2. The electrical system of claim 1 wherein the default reciprocating pump activity level is dynamically selected by a user.

3. The electrical system of claim 2 wherein the user interface enables a user to dynamically select the default reciprocating pump activity level.

4. The electrical system of claim 1 further comprising indicators that indicate a default duty cycle and a current duty cycle for the on/off reciprocating pump cycles.

5. The electrical system of claim 4 wherein the default duty cycle for the on/off the reciprocating pump cycles can be adjusted based on user input.

6. The electrical system of claim 1 further comprising indicators that indicate a default reciprocating pump activity level and a current reciprocating pump activity level to a user.

7. The electrical system of claim 1 wherein the power supply is rechargeable.

8. The electrical system of claim 7 wherein the power supply comprises a battery.

9. The electrical system of claim 7 further comprising a solar panel that recharges the power supply.

10. The electrical system of claim 1 further comprising an electric motor coupled to the controller, wherein the controller selectively directs the electric motor to provide the plurality of reciprocating pump activity levels.

11. A method for controlling a chemical injection pump, the method comprising:

displaying a plurality of predetermined integer numbers of on/off reciprocating pump cycles for a corresponding plurality of pump activity levels and receiving a user input identifying a default predetermined integer number of on/off reciprocating pump cycles for a first activity level;

monitoring a power supply voltage;

if the power supply voltage drops below a first predetermined threshold, automatically operating the chemical injection pump at a second reciprocating pump activity level of the plurality of reciprocating pump activity levels to reduce power consumption of the chemical injection pump, the second reciprocating pump activity level associated with a lower predetermined integer number of on/off reciprocating pump cycles than the first activity level, if the voltage of the power supply drops below a second threshold, automatically causing the chemical injection pump to operate at a minimum reciprocating pump activity level, the minimum reciprocating pump activity level associated with a lower predetermined integer number of on/off reciprocating pump cycles than the second activity level, if the voltage of the power supply drops below a third threshold, automatically causing the chemical injection pump to turn off, and if the voltage of the power supply rises above the first threshold, automatically causing the chemical injection pump to operate at the first activity level, wherein each of the plurality of reciprocating pump activity levels corresponds to a different predetermined integer number of on/off reciprocating pump cycles within a time period.

12. The method of claim 11 further comprising dynamically selecting the default reciprocating pump activity level.

13. The method of claim 11 further comprising operating the chemical injection pump, for each of a plurality of power supply voltage thresholds, at a predetermined number of on/off reciprocating pump cycles per time period and a predetermined duty cycle for each on/off reciprocating pump cycle.

14. The method of claim 11 further comprising controlling an electric motor to operate the chemical injection pump and recharging a power supply for the chemical injection pump using a solar panel.

* * * * *